US007022928B2

(12) United States Patent
Watanabe et al.

(10) Patent No.: US 7,022,928 B2
(45) Date of Patent: Apr. 4, 2006

(54) PUSH-ON SWITCH

(75) Inventors: Hisashi Watanabe, Katsuta-gun (JP); Koji Tamano, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/894,531

(22) Filed: Jul. 20, 2004

(65) Prior Publication Data

US 2005/0029084 A1 Feb. 10, 2005

(30) Foreign Application Priority Data

Aug. 7, 2003 (JP) ..... 2003-288722

(51) Int. Cl.
*H01H 5/18* (2006.01)
*H01H 3/42* (2006.01)

(52) U.S. Cl. ..... 200/406; 533/292

(58) Field of Classification Search .... 200/16 R–16 D, 200/516, 517, 520, 521, 522, 533–537, 542, 200/551, 284, 292, 406, 296
See application file for complete search history.

(56) References Cited

U.S. PATENT DOCUMENTS 4,314,118 A * 2/1982 Ohkita et al. ..... 200/16 F
4,997,996 A * 3/1991 Ohashi ..... 200/296
5,426,274 A * 6/1995 Bruggemann et al. ..... 200/523
6,107,586 A * 8/2000 Takeuchi et al. ..... 200/535
6,262,383 B1 * 7/2001 Nishikawa ..... 200/406
6,433,291 B1 * 8/2002 Mori et al. ..... 200/437
6,756,554 B1 * 6/2004 Hu ..... 200/406

FOREIGN PATENT DOCUMENTS

| | | |
|---|---|---|
| CN | 2562336 Y | 7/2003 |
| JP | 5-1126 U | 1/1993 |
| JP | 10-144175 | 5/1998 |

* cited by examiner

*Primary Examiner*—Michael A. Friedhofer
(74) *Attorney, Agent, or Firm*—RatnerPrestia

(57) ABSTRACT

A push-on switch is pushed horizontally to the surface of a printed wiring board used in various electronic apparatuses. The push-on switch is of a surface mounted type, in which only front terminals lead from case can be extended vertically downwardly and soldered to the inside of through holes in land parts having the through hole of printed wiring board. Front terminals work as a maintaining means for maintaining a stable mounted state to improve proof strength against an operating force horizontal to the printed wiring board surface. Therefore, the stable mounted state to the printed wiring board is kept also when horizontal pushing is repeated.

6 Claims, 9 Drawing Sheets

PUSH-ON SWITCH

BACKGROUND OF THE INVENTION

1. Field of the Invention

The present invention relates to a push-on switch that is operated by being pushed horizontally to a printed wiring board surface used for various electronic apparatuses.

2. Background Art

Recently, for operating an electronic apparatus, a method of performing a predetermined operation using an operating unit formed of arranged push-on switches has become widespread.

Various operation methods of push-on switches have been required with widespread use of various apparatuses. The demand for a push-on switch to be pushed horizontally to a printed wiring board surface increases. Small and light apparatuses are manufactured, so that especially surface-mounted-type push-on switches are preferred.

Japanese Patent Unexamined Publication No. H5-1126 discloses a conventional push-on switch that is operated by being pushed horizontally to a printed wiring board surface.

The conventional push-on switch is described with reference to FIG. 9 to FIG. 11.

The conventional push-on switch has center contact 2 and outside contacts 3 on the inner bottom surface of an upwardly opening recessed part of case 1. Case 1 is rectangular in a view from the upside. Center contact 2 is connected to terminals 4 projecting from the side faces of case 1, and outside contacts 3 are connected to terminals 5 projecting from the side faces of case 1.

Terminals 4 and terminals 5 are formed in a shape allowing mounting on a surface of so called a J bent type and are projected from the bottom of case 1 to the side.

Movable contact 6 is formed of a metal thin plate and has a dome shape projecting upwardly. The lower end of the outer periphery of movable contact 6 is placed on outside contacts 3 exposed in the recessed part of case 1 in an always contacting state.

At this time, the lower surface of the center top of movable contact 6 is faced to center contact 2 at a predetermined distance. Movable contact 6 is disposed so that the position thereof is regulated by the inner wall of the recessed part of case 1, and is adhered and held on intermediate step 1D of case 1 using flexible insulating sheet 7 having an adhesive layer on its lower surface. Here, flexible insulating sheet 7 has a structure for improving dust proofing performance of a contact part by adhering the center top of movable contact 6 to intermediate step 1D.

Operation body 8 made of insulating resin is a molded body including outer peripheral frame 9, pressing part 10 that is disposed in a central part of outer peripheral frame 9 and extends to the back side thereof in a bar shape, and operation part 11 projecting to the front side of outer peripheral frame 9.

As shown in FIG. 9 and FIG. 11, the front side corresponds to direction F of the arrow, and the back side corresponds to direction B of the arrow. Direction B corresponds to the pushing direction of operation part 11, and direction F corresponds to the returning direction thereof.

Operation body 8 is regulated by the wall of case 1, disposed movably only in the horizontal and longitudinal direction with respect to the bottom of case 1, and placed on flexible insulating sheet 7 so as to project operation part 11 to the front side (direction F).

Metallic cover 12 is disposed on case 1 so as to cover operation body 8 and is connected to case 1.

A central part of cover 12 has regulating part 13 that downwardly tilts toward the case 1 side, and the inner surface of regulating part 13 abuts on the tip of pressing part 10 of operation body 8.

The structure of the conventional push-on switch of the surface mounted type has been described.

Operations of the push-on switch are hereinafter described. FIG. 11 shows the OFF state of the switch. When operation part 11 of operation body 8 is pushed horizontally from the OFF state to the back side (direction B), operation body 8 moves in direction B.

At this time, the tip of pressing part 10 is guided to the downside of case 1 by regulating part 13 of cover 12, and the lower surface of pressing part 10 has a force of pressing down movable contact 6 via flexible insulating sheet 7.

When the force of pressing down movable contact 6 by pressing part 10 exceeds a predetermined value, movable contact 6 is inverted with click feeling. When inverted movable contact 6 contacts with center contact 2 on the lower surface of the center top, the ON state is obtained. Here, in the ON state, movable contact 6 electrically connects between center contact 2 and outside contacts 3, namely between terminals 4 and terminals 5.

When the operating force of operation body 8 to operation part 11 in direction B is removed, movable contact 6 returns to an original shape due to own elastic restoring force and pushes up pressing part 10 via flexible insulating sheet 7, operation body 8 returns to the forward original position with pressing part 10 guided by regulating part 13, and the switch returns to the OFF state as shown in FIG. 11.

In the conventional push-on switch of the surface mounted type that is pushed horizontally to the printed wiring board surface, terminals 4 and 5 are generally reflow-soldered to the printed wiring board of a used apparatus.

Since the operating direction is pushed horizontally to the mounted printed wiring board in the push-on switch of this type, the influence of the operating force on the connecting parts between terminals 4 and 5 and the printed wiring board must be considered, and the control of the mounted state to the printed wiring board is significant. The control is difficult to be simplified.

SUMMARY OF THE INVENTION

A push-on switch of the present invention is operated by being pushed horizontally to a mounted printed wiring board. The push-on switch has the following elements:

a case having an opening in its side face;

an operation body projecting from the opening and movably stored in the case; and a maintaining means that is disposed on the front side of the pushing direction of the operation body and fixes the switch to the printed wiring board. The push-on switch, thanks to the maintaining means, is stably mounted to the printed wiring board also when a pushing operation is repeated. Especially, the maintaining means is disposed on the front side of the pushing direction by the printed wiring board, so that reliability of the connecting part to the printed wiring board is improved and the quality control of the connecting state can be simplified even when the operating direction is inclined slightly vertically.

DETAILED DESCRIPTION OF THE INVENTION

Figure 1:
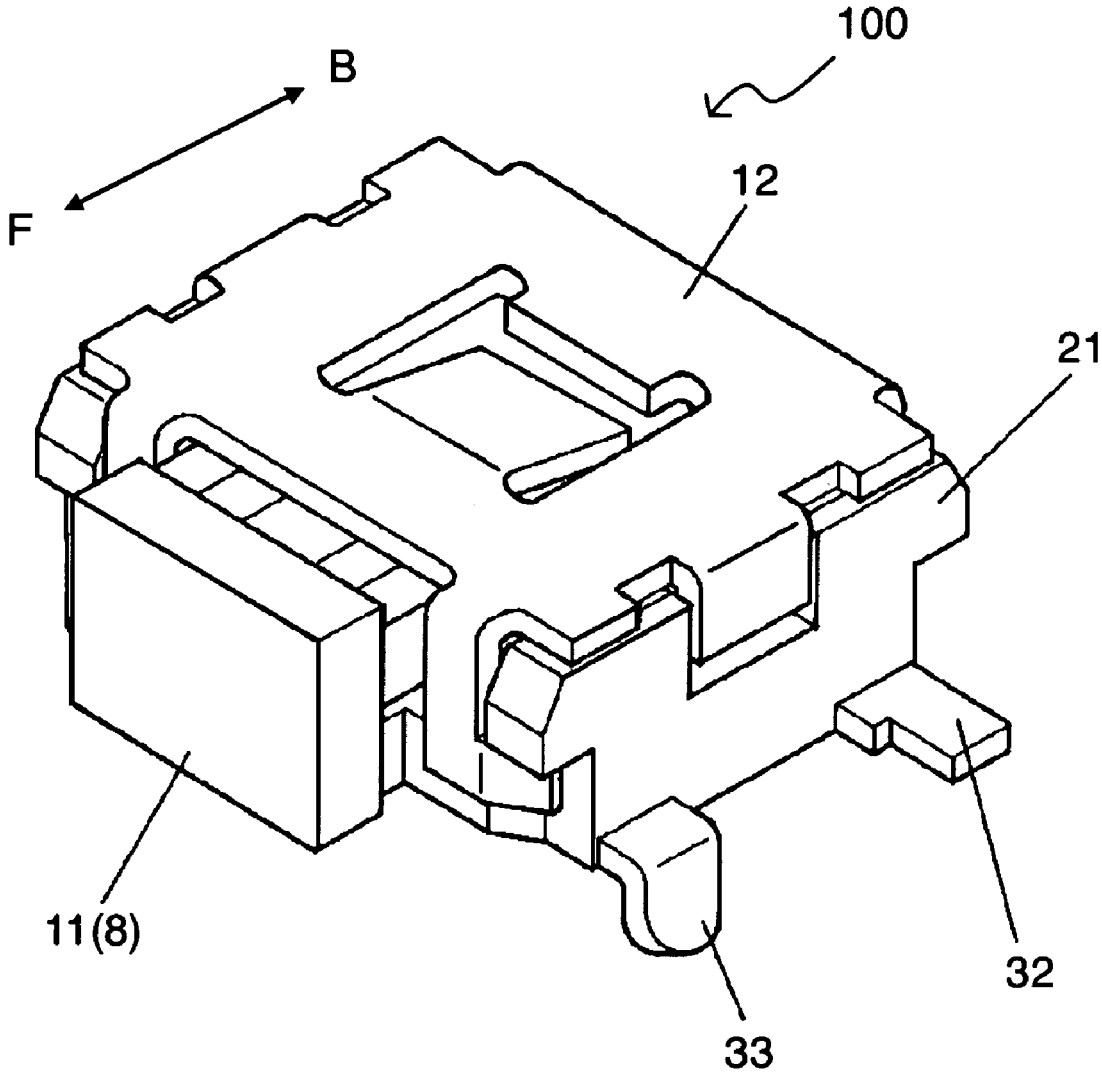
FIG. 1 is a perspective view of a push-on switch in accordance with a first exemplary embodiment of the present invention.
Figure 2:
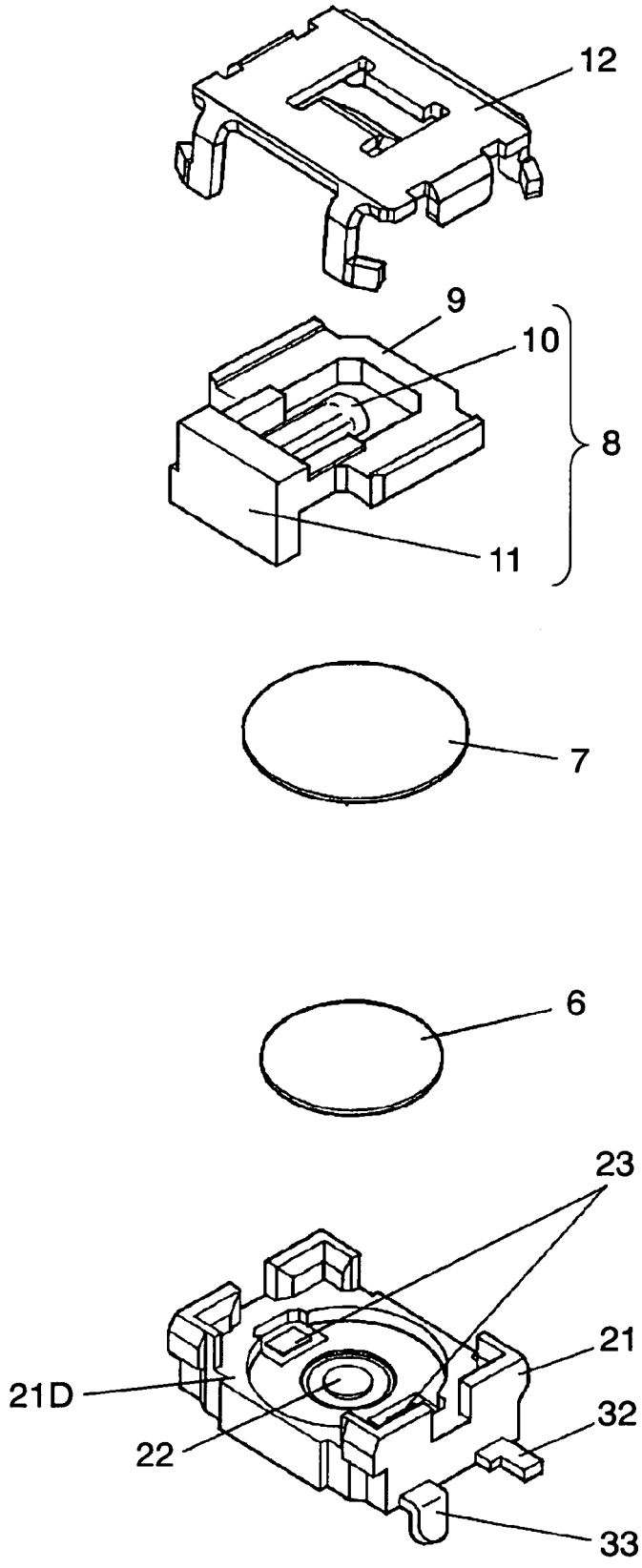
FIG. 2 is an exploded perspective view of the push-on switch in accordance with the first exemplary embodiment.

A push-on switch of the present invention has a maintaining means at a position on the front side corresponding to the end side of a printed wiring board to which the switch is mounted. Therefore, even when a pushing operation is repeated, advantageously, a mounted state to the printed wiring board can be stably maintained, and quality control or the like of the connecting part between a terminal and the printed wiring board can be simplified.

(Exemplary Embodiments)

A push-on switch of the present invention will be specifically described in accordance with exemplary embodiments.

Elements similar to those described in the conventional art are denoted with the same reference numbers, and the descriptions of those elements are omitted.

An exemplary embodiment of the present invention is described with reference to FIG. 1 to FIG. 6.

Push-on switch 100 of the exemplary embodiment has a substantially rectangular plane shape and has insulating-resin-made case 21 having an upwardly opening recessed shape. Center contact 22 and outside contacts 23 are fixed onto the bottom face of the recessed part of case 21. Movable contact 6 having a circular dome shape positioned by the inner wall of the recessed part of case 21 is stored on outside contacts 23.

The lower surface of the center top of stored movable contact 6 is faced to center contact 22 at a predetermined distance. Flexible insulating sheet 7 having an adhesive on its lower surface is stuck on intermediate step 21D forming the recessed part of case 21. Flexible insulating sheet 7 adheres and holds the center top of movable contact 6 with the adhesive.

Figure 3:
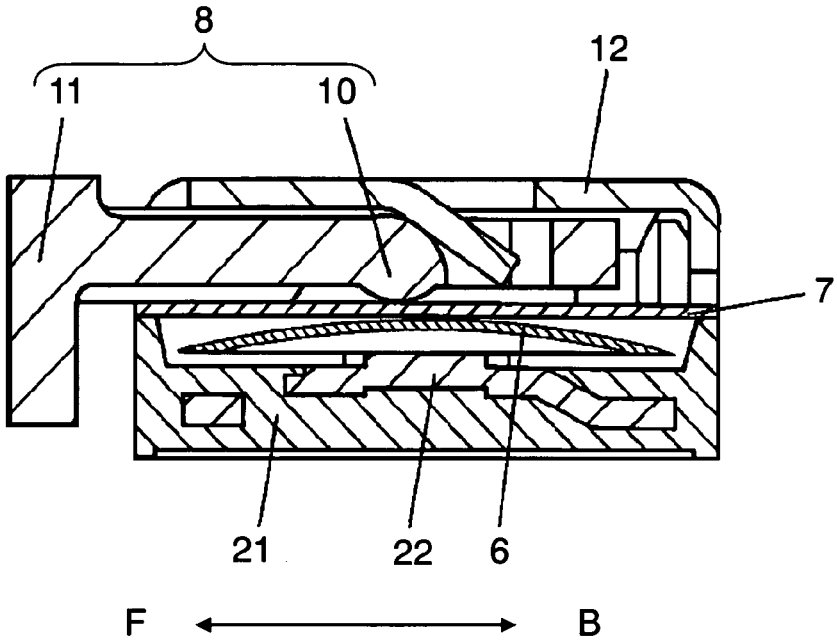
FIG. 3 is a sectional view of the push-on switch in accordance with the first exemplary embodiment.

Operation body 8 is placed over flexible insulating sheet 7 similarly to the conventional art. Operation body 8 includes outer peripheral frame 9, pressing part 10 that is disposed in a central part of outer peripheral frame 9 and extends to the back side in a bar shape, and operation part 11 projecting to the front side of outer peripheral frame 9. Operation body 8 is regulated by the wall disposed in case 21, and is movable only in the horizontal and longitudinal direction. Operation part 11 projects outwardly on the front side from the opening in the side face of case 21. As shown in FIG. 1 and FIG. 3, the front side corresponds to direction F of the arrow, and the back side corresponds to direction B of the arrow. Direction B corresponds to the pushing direction of operation body 8, and direction F corresponds to the returning direction thereof. Metallic cover 12 is disposed on case 21 including the above part of operation body 8 and is connected to case 21.

In switch 100, terminals are lead from center contact 22 and outside contacts 23 to the outside of case 21.

Switch 100 is of a surface mounted type. Front terminals 33 and back terminals 32 are lead from the side faces of case 21 in parallel with a printed wiring board surface. Only front terminals 33 are bent from the proximity of the lead bottom and formed toward the vertically downside of the printed wiring board surface.

Front terminals 33 disposed on the front side with respect to pushing direction B work as a terminal, and operate as a maintaining means for applying proof strength to the pushing force horizontal to the printed wiring board surface. The front side with respect to the pushing direction B means a region of the case on the side of operation part 11, and the front side involves substantially a half of the case in the pushing direction.

Figure 6:
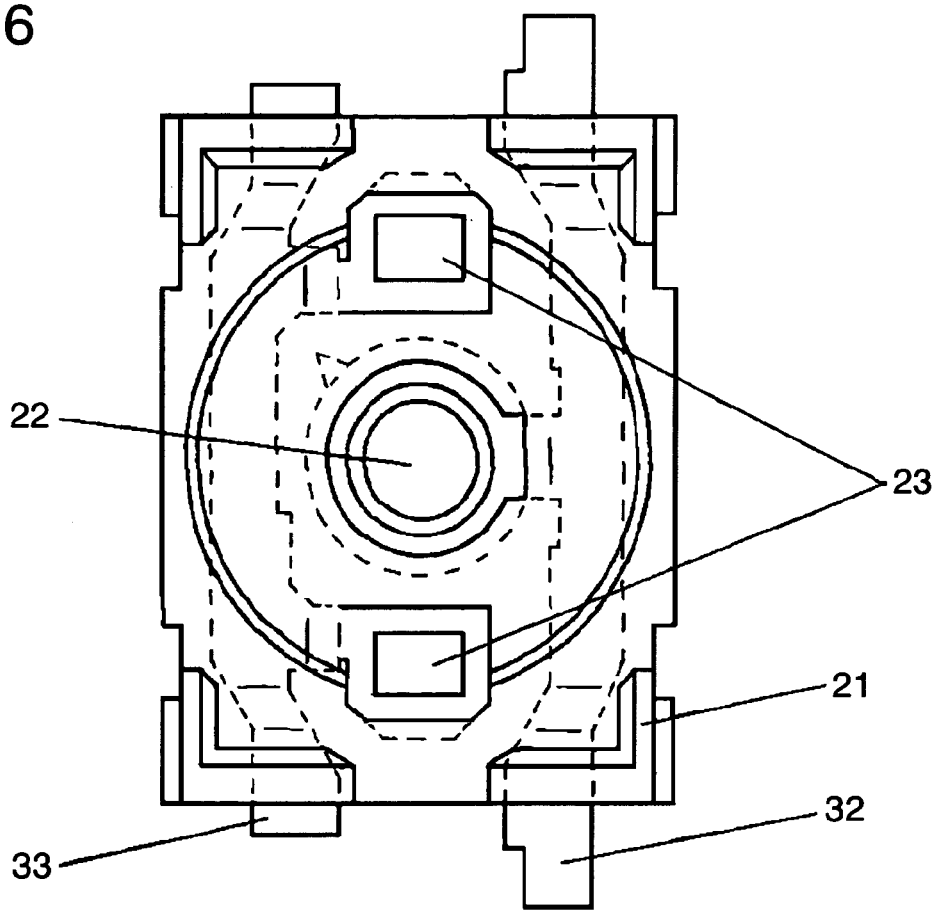
FIG. 6 is a top view of a case as an essential part of the push-on switch in accordance with the first exemplary embodiment.

As shown in the top view of the case of FIG. 6, two back terminals 32 are lead from center contact 22 and disposed at back positions on the right and left side faces of case 21. Two front terminals 33 are lead from outside contacts 23 and disposed at front positions on the right and left side faces of case 21.

Figure 4:
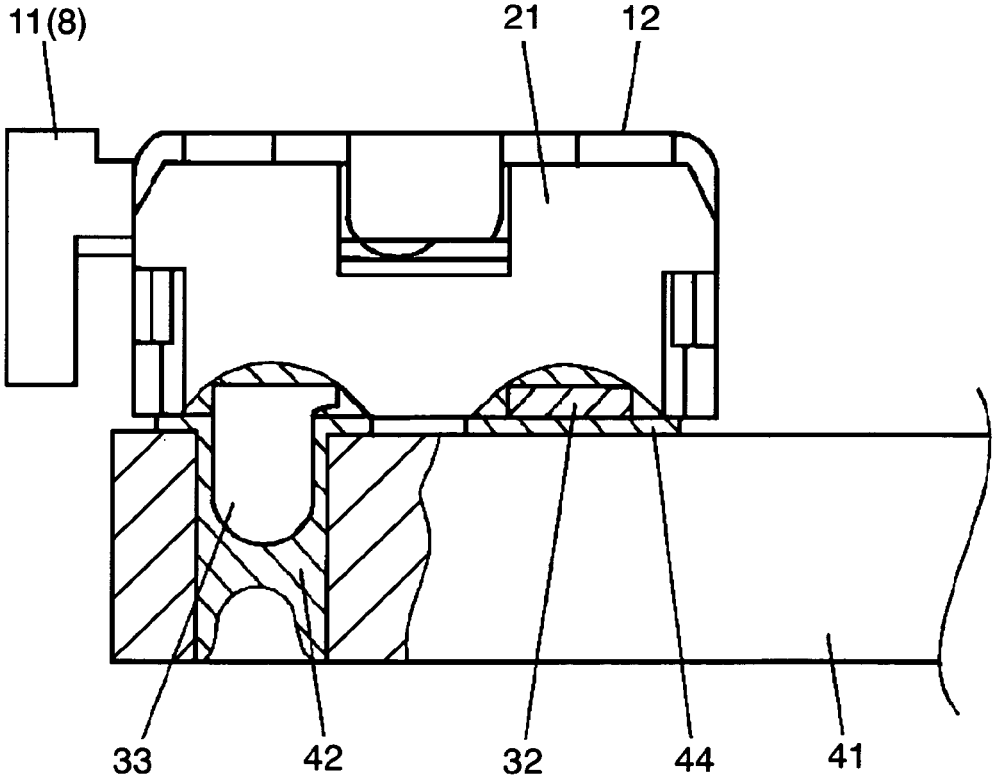
FIG. 4 is a side view showing a mounted state of the push-on switch to a printed wiring board in accordance with the first exemplary embodiment.
Figure 5:
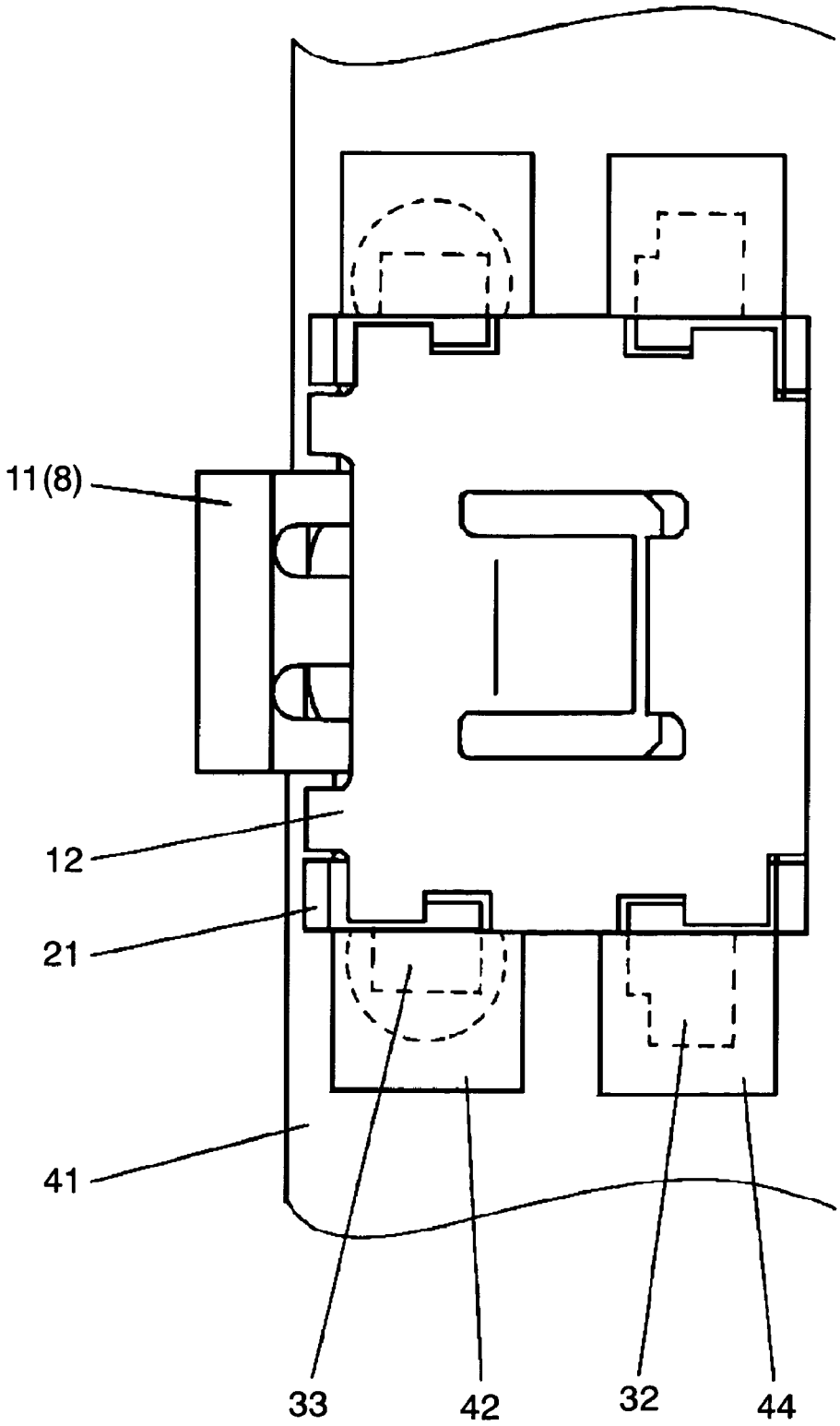
FIG. 5 is a top view showing the mounted state of the push-on switch to the printed wiring board in accordance with the first exemplary embodiment.

As shown in FIG. 4 and FIG. 5, front terminals 33 of switch 100 are inserted into through holes in land parts 42 having the through hole, and soldered and fixed to the inside of the through holes. Here, land parts 42 are disposed near the front end of printed wiring board 41 to which switch 100 is mounted. Back terminals 32 are soldered and fixed to land parts 44 disposed on the upper surface of printed wiring board 41.

When the length of front terminals 33 is set at a length at which the lowest position does not exceed the thickness of printed wiring board 41, efficient mounting is allowed, and the lower side of printed wiring board 41 or the under space thereof can be effectively used.

The length of inserted front terminals 33 may be set at the thickness of printed wiring board 41 or longer. In this case, land parts 42 having the through hole of printed wiring board 41 may be formed not on the switch 100 mounted surface of the board but only on the lower surface, of the board and inserted front terminals 33 may be soldered and fixed.

Land parts 42 of printed wiring board 41 may be formed both on the switch 100 mounted surface (upper surface) and on the opposite surface (lower surface), and front terminals 33 may be soldered both on the upper surface and on the lower surface of printed wiring board 41. Switch 100 mounted to printed wiring board 41 in accordance with the present exemplary embodiment is hereinafter described.

When operation part 11 projecting on the front side of operation body 8 is pushed to the back side (pushing direction B) horizontally to the printed wiring board surface, the lower surface of pressing part 10 obtains a force of pressing down movable contact 6, and the inversion of movable contact 6 electrically connects center contact 22 to outside contacts 23.

A force in direction B parallel with printed wiring board 41 is applied to the push-on switch in this operation. Font terminals 33 extended orthogonally to the operating direction are inserted into the through holes in land parts 42 and soldered in switch 100. The proof strength to the horizontal operation can be therefore improved.

When the operating force is removed, movable contact 6 returns to an original upwardly-projecting shape, center contact 22 and outside contacts 23 return to electrically disconnected state, and the energizing force is turned to the horizontal direction to push back operation body 8 to the front side (returning direction F) to return operation part 11 to the forwardly projecting state.

In the push-on switch of the present exemplary embodiment, front terminals 33 are fixed to printed wiring board 41 orthogonally to the operating direction, so that the mounted state is stabilized for a long time even when the operation horizontal to the printed wiring board surface is repeated. The reason why only front terminals 33 near the end side of printed wiring board 41 are extended orthogonally to the printed wiring board surface is that the influence of the operating force is larger on a fixed part to printed wiring board 41 on the front side than on a fixed part to printed wiring board 41 on the back side.

When the push-on switch is mounted to the apparatus, generally, operation part 11 is assembled in a structure where operation part 11 is pushed horizontally to the printed wiring board surface by a push button or the like of the apparatus. In some assembled configuration of apparatuses, however, the push-on switch is often pushed not horizontally to the printed wiring board surface but is pushed in vertically and laterally tilting directions. In this case, stress caused by pushing operation part 11 at a different operation angle is mainly loaded to front terminals 33 fixed to printed wiring board 41 near operation part 11. Therefore, sufficient reliability can be secured for operations from various directions by leading front terminals 33 vertically to the printed wiring board surface.

Since front terminals 33 also have a structure where they are projected from the right and left side faces of case 21 and inserted into and fixed in the through holes of land parts 42 under case 21. The influence during the operation can be therefore reduced on both sides of the front part of the outline of the push-on switch of the present invention, and strength against a laterally tilted pushing is increased.

As discussed above, the push-on switch of the present embodiment has a structure where front terminals 33 have the maintaining means in addition to a terminal function, peeling or the like from printed wiring board 41 can be prevented also when the push-on switch is repeatedly operated.

In the structure having the maintaining means, the mounted state to printed wiring board 41 can be stably maintained also when the push-on switch is repeatedly operated, and control of a connecting state of terminals 33 and 32 to printed wiring board 41 can be also simplified.

Front terminals 33 are connected to outside contacts 23, back terminals 32 are connected to center contact 22, and front terminals 33 are connected to a ground pattern (not shown) of printed wiring board 41, thereby allowing ground measures of the switch.

When front terminals 33 are connected to the ground pattern, movable contact 6 always contacting with front terminals 33 via outside contacts 23 can be grounded. Static electricity flowing from a human body into operation part 11 during the operation can be made to flow to the ground of printed wiring board 41 via movable contact 6 close to operation part 11 and front terminals 33. As a result, the influence of the static electricity on switch signals can be eliminated, and reliability of the switch signals can be improved.

Another exemplary embodiment of the present invention is described with reference to FIG. 7 and FIG. 8.

In a push-on switch of this second exemplary embodiment of the present invention, a maintaining means extended vertically to the printed wiring board surface has a structure different from the push-on switch of the first exemplary embodiment. Elements similar to those described in the first exemplary embodiment are denoted with the same reference numbers, and the descriptions of those elements are omitted.

Figure 7:
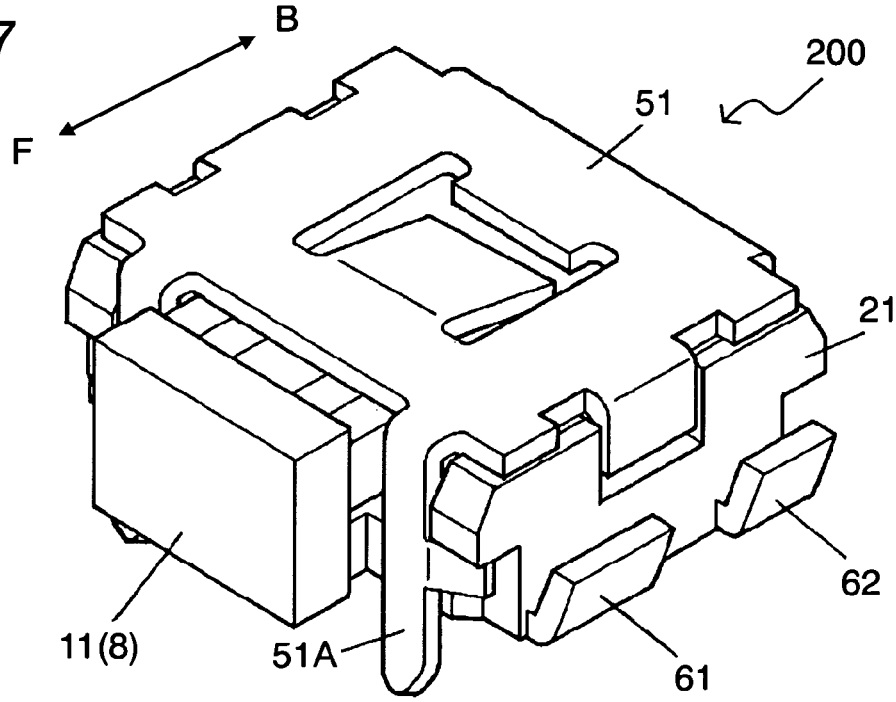
FIG. 7 is a perspective view of a push-on switch in accordance with a second exemplary embodiment of the present invention.
Figure 8:
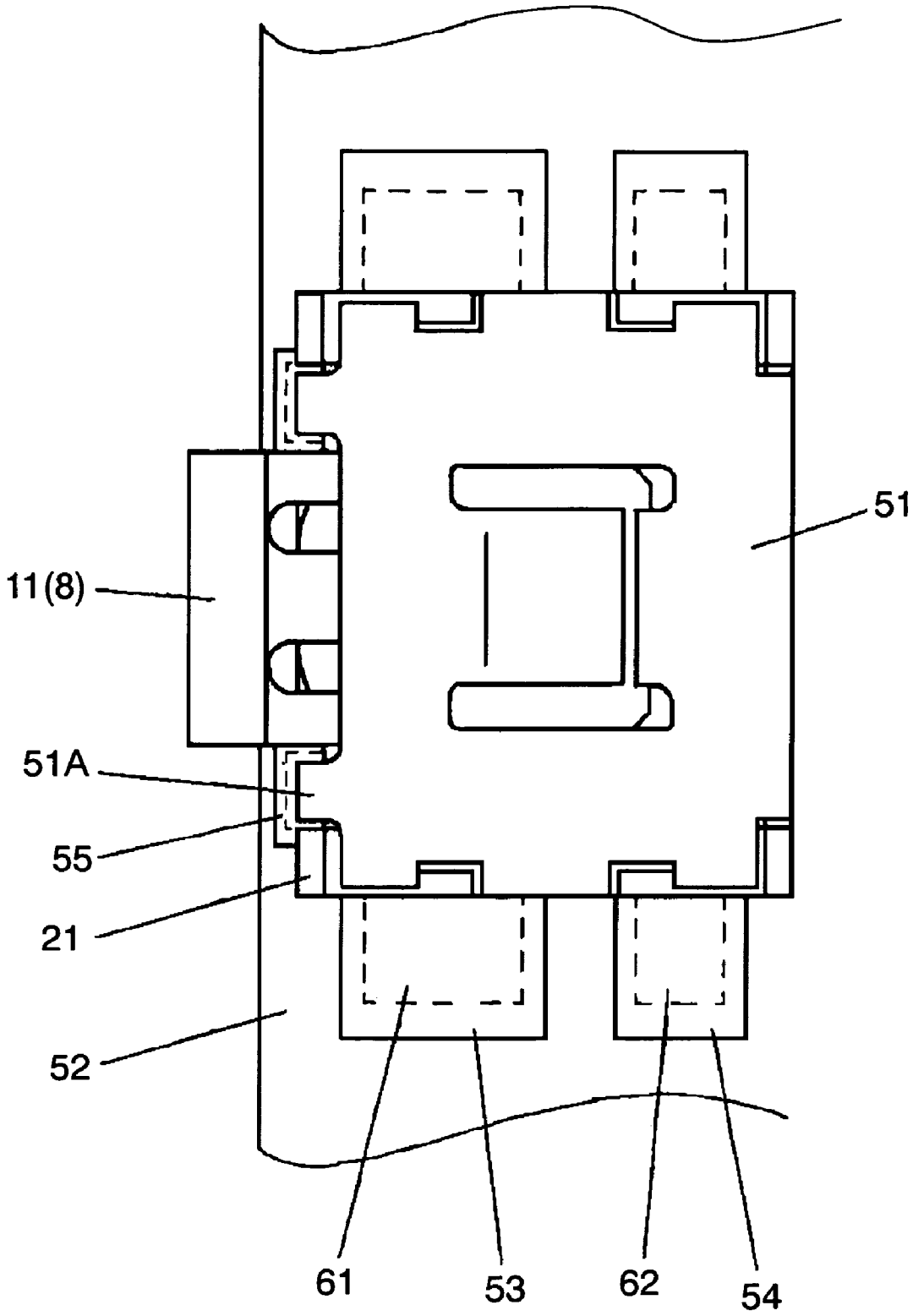
FIG. 8 is a top view showing a mounted state of the push-on switch to a printed wiring board in accordance with the second exemplary embodiment.
Figure 9:
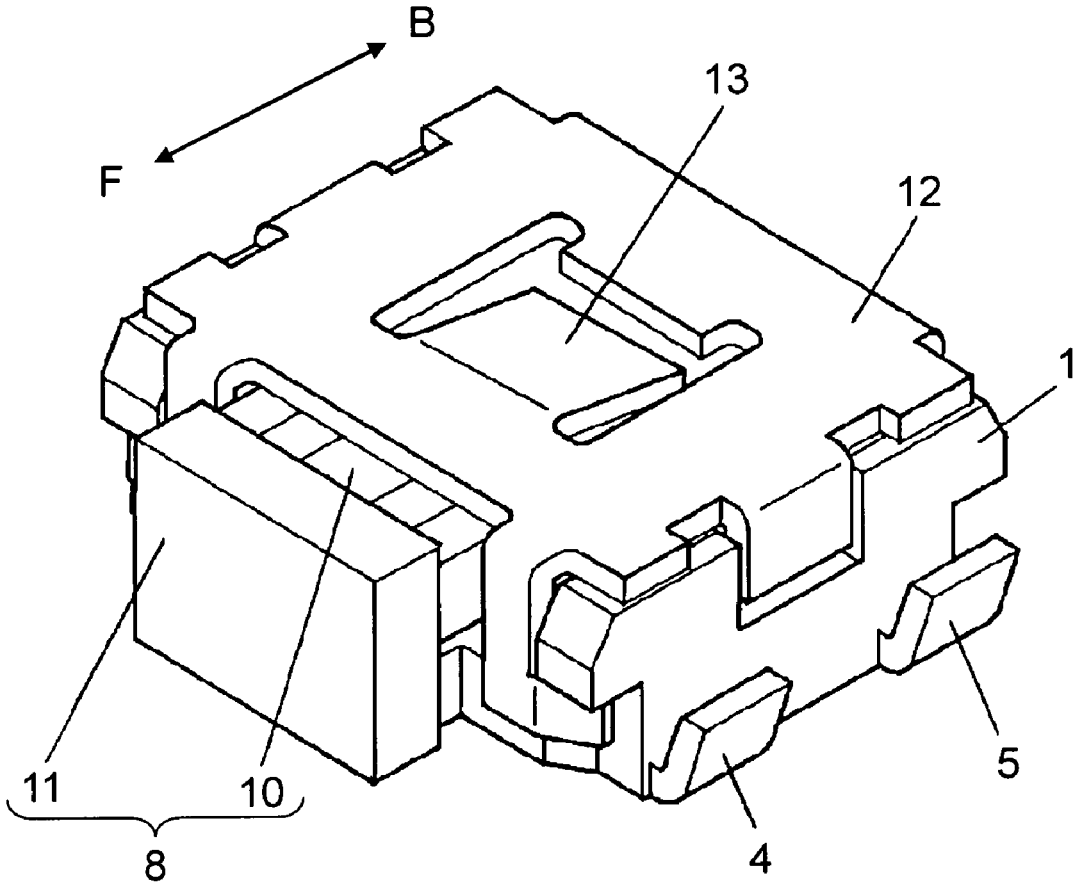
FIG. 9 PRIOR ART
FIG. 9 is a perspective view of a conventional push-on switch.
Figure 10:
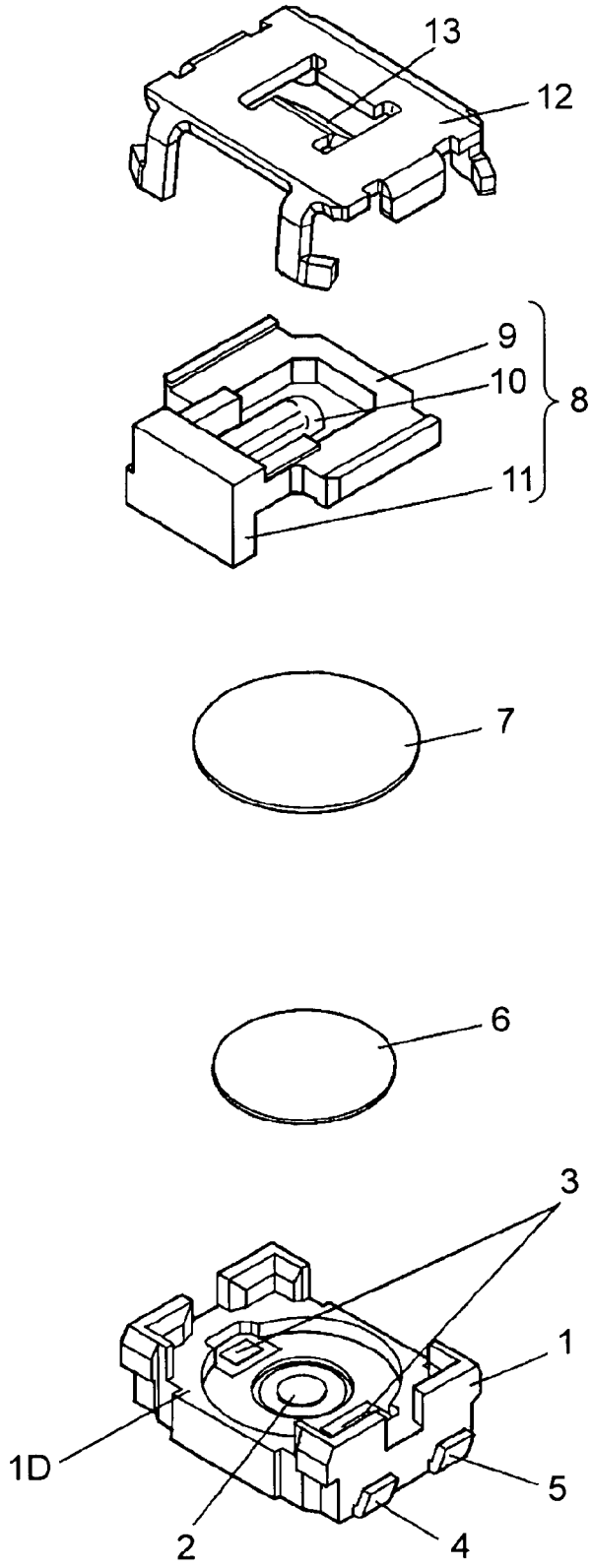
FIG. 10 PRIOR ART
FIG. 10 is an exploded perspective view of the conventional push-on switch.
Figure 11:
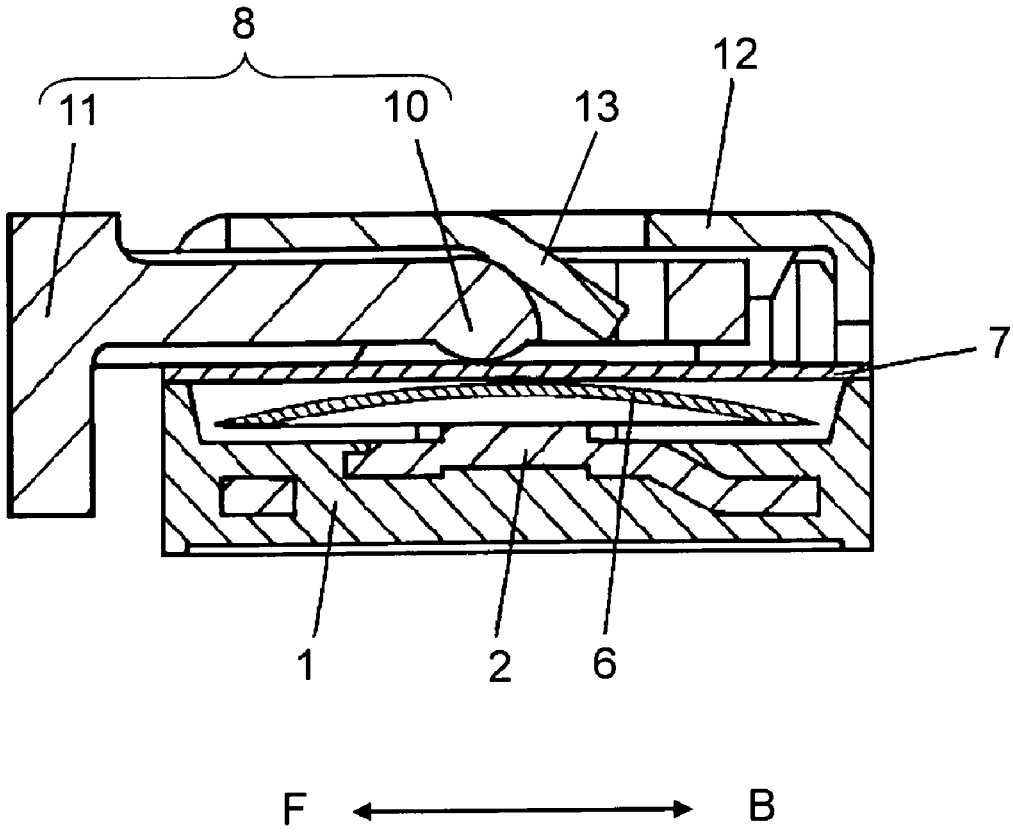
FIG. 11 PRIOR ART
FIG. 11 is a sectional view of the conventional push-on switch.

As shown in FIG. 7 and FIG. 8, push-on switch 200 of the second exemplary embodiment has leg parts 51A on the front side with respect to the pushing direction. Leg parts 51A are extended vertically to the printed wiring board surface and work as the maintaining means. Leg parts 51A lie in the front parts of cover 51, and front terminals 61 and back terminals 62 are of so called a J-bent terminal. Front terminals 61 correspond to terminals on the front side (direction F side) with respect to the pushing direction of switch 200, and back terminals 62 correspond to terminals on the pushing direction side.

Front terminals 61 on the front side with respect to pushing direction B are wider than back terminals 62 and have a soldering area larger than that of them. The terminals having such large soldering area work as one of maintaining means of the present invention.

Cover 51 holds operation body 8 longitudinally movably with respect to case 21 having a contact part, and is joined to the upper part of case 21. On both sides of operation part 11 projecting to the front side of operation body 8, leg parts 51A as the maintaining means are extended on the vertically down side with respect to the printed wiring board surface. The maintaining means is a characteristic of the present invention.

In push-on switch 200 of the second exemplary embodiment, as shown in FIG. 8, front terminals 61 and back terminals 62 are soldered to land parts 53 and 54 on printed wiring board 52, leg parts 51A are inserted into through holes of land parts 55 having the through holes and soldered with the inside of the through holes.

When the lowest position of leg parts 51A is set at a length that does not exceed the thickness of printed wiring board 52, efficient mounting is allowed and the lower surface of printed wiring board 52 or the under space thereof can be effectively used.

Leg parts 51A disposed on the printed wiring board surface on the vertically down side are fixed to the front end position of printed wiring board 52, thereby improving strength against a pushing operation horizontal to the printed wiring board surface.

When leg parts 51A disposed on cover 51 upwardly away from the printed wiring board surface are fixed to printed wiring board 52 and used as the maintaining means, a stable mounted state is allowed also in the height direction of switch 200. In other words, leg parts of the cover are soldered, so that backlash is prevented and the height of the cover 51 after mounted to the printed wiring board 52 is stabilized.

Leg parts 51A are electrically connected to a ground pattern (not shown) of printed wiring board 52, thereby facilitating measures against static electricity flowing into operation part 11.

When cover 51 and leg parts 51A are unitarily molded, the number of components does not increase and it is preferable.

Leg parts as the maintaining means may be formed of a separate member. For example, instead of leg parts 51A, projections having a predetermined shape are formed in the front part of case 21, the projections may be inserted into holes formed in the printed wiring board or may be contacted with the end of the printed wiring board to function as the maintaining means.

It is important that leg parts 51A of cover 51 working as the maintaining means discussed above are fixed to printed wiring board 52 and disposed on the front side (direction F side) of terminals 61 and 62 with respect to the pushing direction so that an operating force of operation part 11 can be dispersed by leg parts 51A.

As shown in FIG. 8, simply when the installation area of only front terminals 61 is set large, the influence of an especially large operating force on front terminals 61 can be absorbed, and the proof strength is improved to maintain the mounted state.

The front part of the case may be adhered to the printed wiring board to improve proof strength. In this case, it is effective that the adhesion part is set on the front end side (the front side with respect to the pushing direction) of the printed wiring board, namely in front of the soldering position of the front terminals.

Various structures of the maintaining means described in the embodiments may be individually used or combined, or the other structures may be used.

INDUSTRIAL APPLICABILITY

A push-on switch can advantageously maintain a mounted state of it to the printed wiring board even when the switch is repeatedly pushed horizontally, and is useful in a case that operation parts of various electronic apparatuses are formed.

What is claimed is:

1. A push-on switch to be pushed substantially parallel to a surface of a printed wiring board to which the push-on switch is mounted, the push-on switch comprising:

a case having an opening in a side face;

an operation body projecting from the opening and movably stored in the case; and maintaining means that is disposed on a front side of the switch with respect to the pushing direction and fixes the switch to the printed wiring board, the maintaining means comprising a first support and a second support, wherein the first support is provided on a front side of the second support with respect to the pushing direction of the operation body, and the first support is inserted into a through hole formed in the printed wiring board, and held in the printed wiring board, and the second support extends from the case substantially parallel to the surface of the printed wiring board.

2. A push-on switch according to claim 1, wherein the first support and the second support are a plurality of terminals that are connected to a plurality of fixed contacts, and the plurality of terminals soldered to the printed wiring board.

3. A push-on switch according to claim 2, further comprising:

a movable contact, and an outside contact and a center contact that are fixed to a bottom of the case, wherein the movable contact is disposed in an always contacting state with the outside contact, the outside contact and the center contact belong to the fixed contacts, and the outside contact is coupled to a terminal on the front side with respect to the pushing direction and coupled to a ground pattern disposed on the printed wiring board.

4. A push-on switch according to claim 1, wherein the second support is a plurality of terminals connected to a plurality of contacts, and the plurality of terminals is soldered to the printed wiring board.

5. A push-on switch according to claim 4, wherein a terminal on the front side with respect to the pushing direction has a coupling area larger than a coupling area of each terminal of the plurality of terminals.

6. A push-on switch according to claim 1, further comprising a cover to be fixed to the case, wherein the first support extends from the cover, the second support is a plurality of terminals that are connected to a plurality of fixed contacts of the switch, and the plurality of terminals is soldered to the printed wiring board.

* * * * *